US007438763B2

(12) United States Patent
Kanke

(10) Patent No.: US 7,438,763 B2
(45) **Date of Patent: *Oct. 21, 2008**

(54) COATING APPARATUS AND METHOD HAVING A SLIDE BEAD COATER AND LIQUID DROP APPLICATOR

(75) Inventor: Shin Kanke, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/676,063

(22) Filed: Feb. 16, 2007

(65) Prior Publication Data

US 2007/0141262 A1 Jun. 21, 2007

Related U.S. Application Data

(62) Division of application No. 10/100,060, filed on Mar. 19, 2002, now Pat. No. 7,208,201.

(30) Foreign Application Priority Data

Mar. 22, 2001 (JP) ..... 2001-82422

(51) Int. Cl.

| | |
|---|---|
| ***B05C 5/02*** | (2006.01) |
| ***B05C 11/00*** | (2006.01) |
| ***B05C 11/06*** | (2006.01) |
| *B05D 1/26* | (2006.01) |
| *B05D 3/00* | (2006.01) |
| *B05D 3/04* | (2006.01) |

(52) U.S. Cl. ..... 118/63; 118/50; 118/73; 118/410; 118/411; 118/DIG. 2; 427/299; 427/348; 427/402; 427/420; 427/294

(58) Field of Classification Search ..... 427/348; 118/63, DIG. 2

See application file for complete search history.

(56) References Cited

U.S. PATENT DOCUMENTS

| | | | | |
|---|---|---|---|---|
| 3,063,838 A | | 11/1962 | Walter et al. | |
| 3,329,523 A | | 7/1967 | Best et al. | |
| 3,335,026 A | * | 8/1967 | De Geest et al. | 427/458 |
| 4,863,765 A | * | 9/1989 | Ishizuka | 427/420 |
| 5,505,995 A | * | 4/1996 | Leonard | 427/348 |
| 5,645,972 A | | 7/1997 | Jonkheere | |
| 5,733,608 A | | 3/1998 | Kessel et al. | |

(Continued)

FOREIGN PATENT DOCUMENTS

EP 0 822 007 A 2/1998

(Continued)

*Primary Examiner*—Katherine A Bareford
(74) *Attorney, Agent, or Firm*—Sughrue Mion, PLLC

(57) ABSTRACT

A coating apparatus and coating method include a device for conveying an object to be coated; a coating device which is disposed in a vicinity of a conveyed surface of the object, and which discharges a coating liquid, and which forms a bridge of the liquid between the device and the object which is conveyed by the device for conveying an object to be coated, and which coats the liquid on at least one surface of the object; and a gas stream blowing device which, immediately after starting of coating, blows out a gas from a direction substantially opposite to a object conveying direction, toward a portion of the object where coating starts.

16 Claims, 10 Drawing Sheets

U.S. PATENT DOCUMENTS 7,208,201 B2 * 4/2007 Kanke ..... 427/299

FOREIGN PATENT DOCUMENTS

JP 63-252575 * 10/1988
JP 01-104376 4/1989
JP 04-244265 * 9/1992
JP 06-000436 1/1994

* cited by examiner

COATING APPARATUS AND METHOD HAVING A SLIDE BEAD COATER AND LIQUID DROP APPLICATOR

CROSS REFERENCE TO RELATED APPLICATION

This is a Divisional of U.S. application Ser. No. 10/100,060 filed Mar. 19, 2002, now U.S. Pat. No. 7,208,201; the entire disclosure of which is incorporated herein by reference.

BACKGROUND OF THE INVENTION

1. Field of the Invention

The present invention relates to a coating apparatus and a coating method, and in particular, to a coating apparatus and a coating method which, at the time of the start of coating, can reliably coat a coating liquid onto an object to be coated such as an aluminum web or the like.

2. Description of the Related Art

Currently, the process of forming an oxidation protective layer from a thin film of an oxygen non-permeable resin, such as polyvinyl alcohol or the like, on the surface of the photosensitive layer of an original lithographic printing plate, so as to protect the photosensitive layer from oxygen in the air, is widely carried out.

In forming the oxidation protective layer, usually, a slide bead type coating apparatus equipped with a slide bead coater and a back-up roller is generally used. A discharge slit, which discharges a coating liquid such as a solution of an oxygen non-permeable resin, and a slide surface, along which the coating liquid discharged from the discharge slit flows down, are formed at the slide bead coater. The back-up roller is provided in a vicinity of the distal end of the slide surface at the slide bead coater, and conveys, in a fixed direction, an original lithographic printing plate which is trained therearound. In this slide bead type coating apparatus, while the original lithographic printing plate is conveyed by the back-up roller such that the photosensitive layer is facing outwardly, the solution is discharged from the discharge slit, and flows down along the slide surface. Between the distal end portion of the slide surface and the surface of the photosensitive layer of the original lithographic printing plate, the solution forms a bridge of coating liquid (a coating bead) such that the solution is coated.

In the slide bead coating apparatus, at the time of the start of coating, the bridge of coating liquid must be reliably formed between the distal end of the slide bead coater and the object to be coated such as the original lithographic printing plate or the like.

Conventionally, the slide bead coater is made to approach the back-up roller such that the clearance between the distal end of the slide bead coater and the original lithographic printing plate on the back-up roller is narrowed. A bridge of the coating liquid is formed between the distal end of the slide bead coater and the lithographic printing plate, and coating of the coating liquid begins.

However, at the time of the start of coating, the coating liquid which has been discharged from the slide bead coater may excessively adhere to the object to be coated, and the coating thickness of the coating liquid at the portion of the object to be coated where coating begins maybe thicker than at other portions, such that a thickly coated portion is formed. When a thickly coated portion is formed, undried portions may remain, and the coated film at the thickly coated portion may be too thick.

Further, in a case in which the width of the slide bead coater is greater than the width of the object to be coated, when coating starts by the above-described method, the coating liquid may adhere to portions of the back-up roller at the outer sides of the original lithographic printing plate. Namely, there are cases in which the coating liquid is transferred, and the transferred coating liquid flows around to the reverse surface of the original lithographic printing plate, such that the reverse surface of the original lithographic printing plate is dirtied.

SUMMARY OF THE INVENTION

In view of the aforementioned, an object of the present invention is to provide a coating apparatus and a coating method which can effectively eliminate thickly coated portions, and which, at the time when coating starts, can reliably form a coating bead, and in which there are no problems such as coating liquid adhering to the reverse surface of the object to be coated, or the like.

In order to achieve the above-described object, in accordance with one aspect of the present invention, there is provided a coating apparatus for coating a coating liquid onto a web which is traveling, the coating apparatus comprising: a slide bead coater which includes at least one discharge slit which discharges the coating liquid, and a slide surface along which the coating liquid from the discharge slit flows down, the slide bead coater forming a bridge of the coating liquid in a gap between a distal end portion of the slide surface and the web; and a liquid drop applying device which is for applying a liquid drop of a predetermined liquid at a web traveling direction upstream side of a position at which the bridge of the coating liquid is formed, and starting formation of the bridge of the coating liquid.

In accordance with another aspect of the present invention, there is provided a coating apparatus for coating a coating liquid onto a web which is traveling, the coating apparatus comprising: a conveying device for making the web travel; a coating device for forming a bridge of the coating liquid between the web and a distal end portion of the coating device; and a blowing device for blowing a gas from a direction which is substantially opposite to a traveling direction of the web, toward a portion of the web at which coating of the coating liquid starts.

In accordance with yet another aspect of the present invention, there is provided a method of coating a coating liquid onto a web by using a slide bead coater which includes a discharge slit which discharges the coating liquid, and a slide surface along which the coating liquid discharged from the discharge slit flows down, the slide bead coater forming a bridge of the coating liquid in a gap between the web and a distal end of the slide surface, the method comprising the steps of: providing the web which travels in a fixed direction; and applying a liquid drop to a portion of the web at a web traveling direction upstream side of a position at which the bridge of the coating liquid is formed.

In accordance with still another aspect of the present invention, there is provided a method of coating a coating liquid onto a web, the method comprising the steps of: providing a web which travels in a fixed direction; forming a bridge of the coating liquid at the web; and blowing a gas from a direction substantially opposite to a web traveling direction, toward a portion where formation of the bridge of the coating liquid starts.

In the present invention, "applying" of liquid drop means making a small amount of a liquid having affinity adhere on a surface of the web (the object to be coated) at the side at which the coating liquid is to be coated. Accordingly, the liquid drop applying device is a means which functions to adhere the liquid drop onto the surface of the web at the side at which the coating liquid is to be coated. A specific example of the liquid drop applying device is an injector or the like.

Examples of liquid which can be applied by the liquid drop applying device are liquids having affinity, which have affinity with respect to both the coating liquid and the web and which have a surface tension which is greater than or equal to that of the coating liquid. Specific examples are solvents such as water or organic solvents or the like which are used in preparing the coating liquid; liquids which are mixed together with such solvents and have a surface tension which is greater than or equal to that of the solvent; the coating liquid itself; diluents formed by diluting the coating liquid by the aforementioned solvent or the aforementioned liquid; and the like.

Examples of the web are base materials which are in a continuous, strip-like form and which are flexible, such as a support for a lithographic printing plate in which the surface of an aluminum web is made conspicuous , and if needed, the surface which is made conspicuous is subjected to an anodizing treatment; an original lithographic printing plate at which a photosensitive layer is formed at the side which has been made conspicuous of the aforementioned support for a lithographic printing plate, and the surface of the photosensitive layer is subjected to a matte processing if needed; base materials for photographic films; baryta paper for photographic printing paper; base materials for audio tapes; base materials for video tapes; base materials for floppy disks; and the like.

Examples of the coating liquid are a photosensitive layer forming solution which is used in forming a photosensitive layer of an original lithographic printing plate; an oxidation protective layer forming liquid whose main component is a solution of an oxygen non-permeable resin, and which is coated on the surface of an original lithographic printing plate so as to form an oxidation protective layer; a photosensitizing agent colloidal liquid for photographic films which is used in forming a photosensitive layer at a photographic film; a photosensitizing agent colloidal liquid for photographic printing paper which is used for forming a photosensitive layer at a photographic printing paper; magnetic layer forming liquids used in forming magnetic layers of audio tapes, video tapes, and floppy disks; and the like.

DESCRIPTION OF THE PREFERRED EMBODIMENTS

1. First Embodiment

Figure 1:
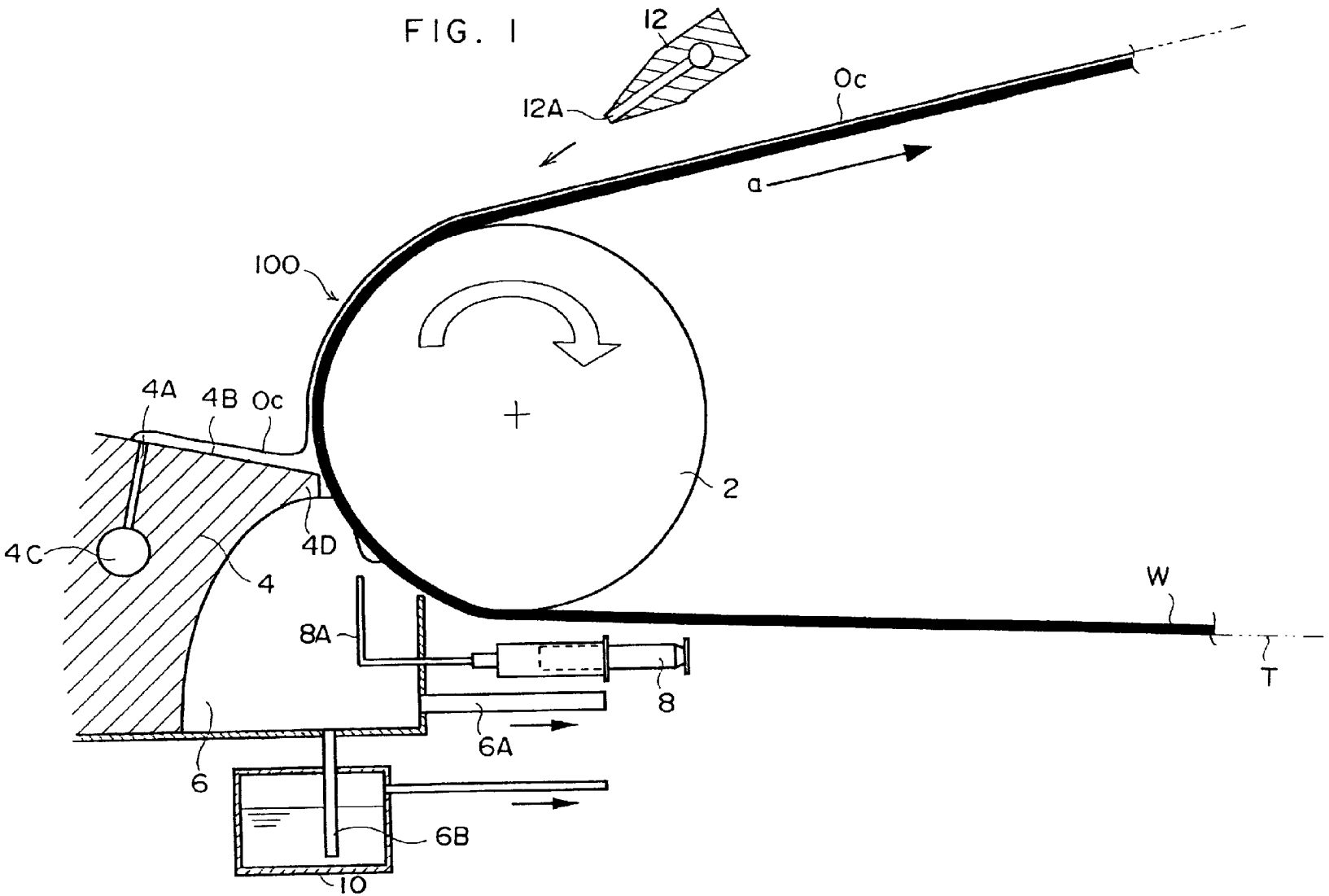
FIG. 1 is a schematic view illustrating a schematic structure of an example of a slide bead type coating apparatus which can be suitably used in implementing a coating method relating to the present invention.

A slide bead type coating apparatus, which is an example of a coating apparatus relating to the present invention, will be described hereinafter with reference to FIGS. 1 through 6C. FIG. 1 illustrates a schematic structure of the slide bead type coating apparatus.

As shown in FIG. 1, the slide bead type coating apparatus 100 relating to the first embodiment includes a back-up roller 2, a slide bead coater 4, a reduced pressure chamber 6, and an injector 8. An original lithographic printing plate web W, which is a web of an original lithographic printing plate, is trained around a side surface of the back-up roller 2. The back-up roller 2 rotates clockwise in FIG. 1 and conveys the original lithographic printing plate web W. The slide bead coater 4 coats, onto the original lithographic printing plate web W which is conveyed while being trained around the back-up roller 2, an oxidation protective layer forming liquid whose main component is a polyvinyl alcohol resin aqueous solution. The reduced pressure chamber 6 is adjacent to the slide bead coater 4 beneath the slide bead coater 4. The injector 8 has the function of applying a water drop to the original lithographic printing plate web W, and corresponds to the liquid drop applying means in the coating apparatus of the present invention. The original lithographic printing plate web W and the oxidation protective layer forming liquid are respectively examples of the object to be coated and the coating liquid of the present invention.

The slide bead coater 4 is a substantially rectangular parallel epiped block, and has a distal end portion 4D which projects toward the back-up roller 2. The edge of the distal end portion 4D is parallel to the side surface of the back-up roller 2. The slide bead coater 4 is disposed such that, when the original lithographic printing plate web W is conveyed while trained around the back-up roller 2, a gap of about 0.1 to 1 mm is formed between the end edge of the distal end portion 4D and the original lithographic printing plate web W. The size of the gap can be determined in accordance with the thickness of a coating layer Oc which is formed by coating the oxidation protective layer forming liquid on the original lithographic printing plate web W.

The slide bead coater 4 is provided with a discharge slit 4A which discharges the oxidation protective layer forming liquid upwardly, a solution supplying hole 4C which is positioned beneath the discharge slit 4A and supplies the oxidation protective layer forming liquid to the discharge slit 4A, and a slide surface 4B which is an inclined surface which inclines downwardly from the discharge slit 4A toward the distal end portion 4D and along which the oxidation protective layer forming liquid discharged from the discharge slit 4A flows. The discharge slit 4A is formed parallel to the aforementioned end edge of the distal end portion 4D. Note that, when a plurality of coating layers are formed on the surface of the original lithographic printing plate web W, a plurality of the discharge slits 4A may be provided in parallel.

An injection needle 8A of the injector 8 penetrates into the reduced pressure chamber 6. At a vicinity of the distal end portion thereof, the injection needle 8A is bent upwardly, and the distal end thereof is positioned in a vicinity of the back-up roller 2 and the distal end portion 4D of the slide bead coater 4.

A pressure reducing tube 6A, which reduces the pressure of the interior of the chamber 6, is provided in a vicinity of the bottom surface of the reduced pressure chamber 6. A liquid discharging tube 6B, which discharges the oxidation protective layer forming liquid which is pooled within the chamber 6, is provided at the bottom surface of the reduced pressure chamber 6 and is directed downward. When the oxidation protective layer forming liquid is coated on the original lithographic printing plate web W, the pressure of the interior of the reduced pressure chamber 6 is reduced to about 0.5 to 10 cm (water column) by a vacuum pump, an aspirator or the like which is connected to the pressure reducing tube 6. A discharged liquid pooling tank 10, in which the oxidation protective layer forming liquid which has been discharged through the liquid discharging tube 6B is pooled, is provided beneath the reduced pressure chamber 6. A pressure reducing tube 10A is provided in a vicinity of the ceiling surface of the discharged liquid pooling tank 10. At the time of coating, the pressure of the interior of the discharged liquid pooling tank 10 as well is, through the pressure reducing tube 10A, reduced to a degree of reduced pressure which is of the same level as that of the interior of the reduced pressure chamber 6.

As shown in FIG. 1, an air blowing nozzle 12 is disposed above the back-up roller 2 along the transverse direction of the original lithographic printing plate web W. The air blowing nozzle 12 blows a stream of air parallel to or at an incline with respect to a conveying direction a of the original lithographic printing plate web W, from a downstream side of the conveying direction a. The air blowing nozzle 12 corresponds to the gas stream blowing means of the coating apparatus of the present invention.

Figure 2A:
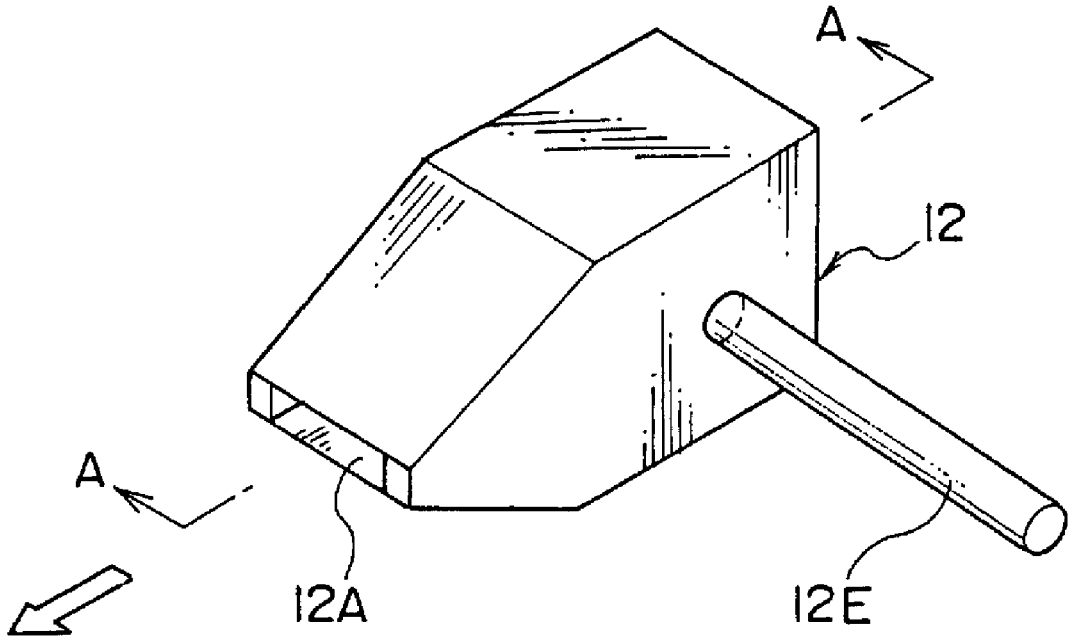
FIGS. 2A and 2B are schematic views illustrating an example of a structure of an air blowing nozzle 12 provided at the slide bead type coating apparatus illustrated in FIG. 1.
Figure 2B:
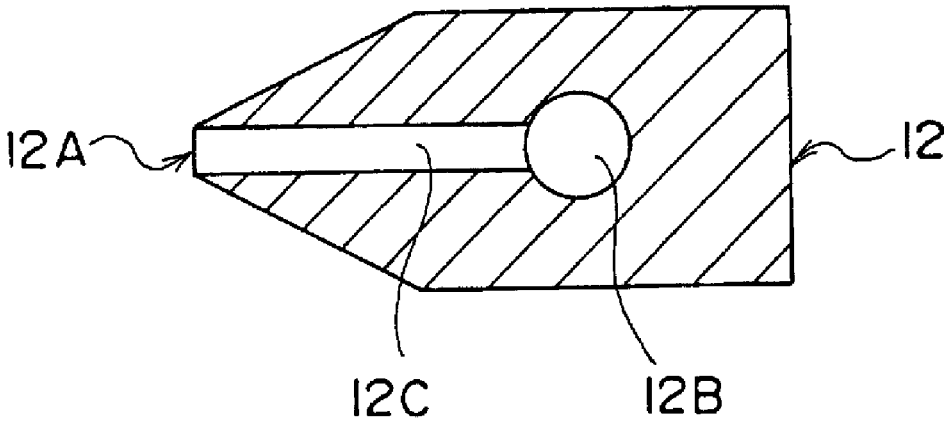
Figure 3A:
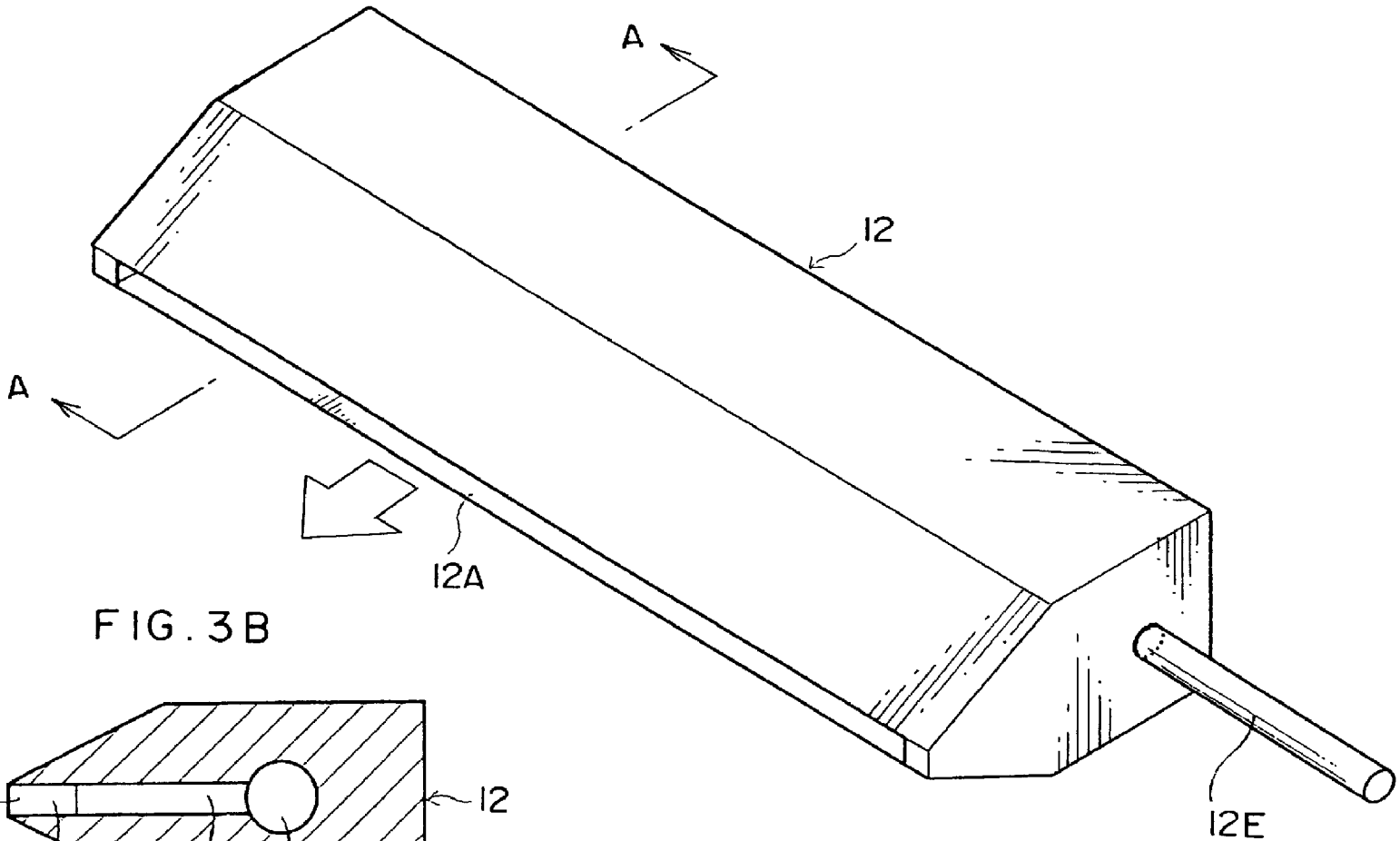
FIGS. 3A and 3B are schematic views illustrating another example of a structure of the air blowing nozzle 12 provided at the slide bead type coating apparatus illustrated in FIG. 1.
Figure 3B:
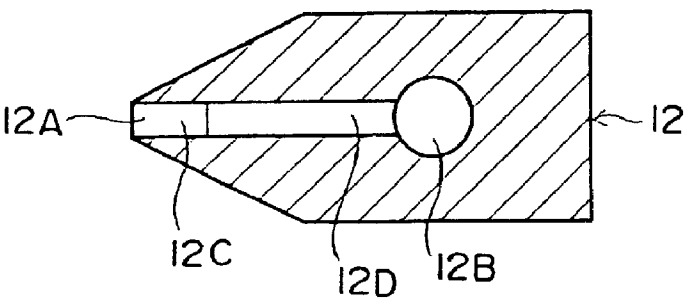

Details of the structure of the air blowing nozzle 12 are shown in FIGS. 2A, 2B, 3A, 3B. FIGS. 2A, 2B illustrate an example of the air blowing nozzle 12 which is used to blow an air stream in the shape of a dot onto the original lithographic printing plate web W. FIGS. 3A, 3B illustrate an example of the air blowing nozzle 12 which is used to blow an air stream over the entire width of the original lithographic printing plate web W. FIGS. 2A, 3A are views as seen from obliquely above the air blowing nozzle 12, and FIGS. 2B, 3B show the air blowing nozzle 12 in cross-sections taken along plane A-A in FIGS. 2A, 3A, respectively.

The air blowing nozzle 12 which is shown in FIGS. 2A, 2B is formed overall in the shape of a rectangular plate. The dimension in the direction orthogonal to the direction of jetting out the air stream shown by the arrow in FIG. 2A, is much smaller than the width of the original lithographic printing plate web W, so as to blow out the air stream in a dot configuration on the original lithographic printing plate web W. The air blowing nozzle 12 has a substantially wedge-shaped cross-section in which the thickness thereof decreases toward one side edge. A continuous slit-shaped air jetting opening 12A, which has a length which is substantially the same as the width of the original lithographic printing plate web W, is formed in this one side edge of the air blowing nozzle 12.

One end of an air supplying tube 12E is connected near the other side edge at one end surface of the air blowing nozzle 12. The air supplying tube 12E supplies air to the air blowing nozzle 12 from an air source (not shown) such as an air bombe, a compressed air pipe, or the like. It is preferable that a filter for removing impurities such as oil drops, dust, or the like in the air is provided at the air source.

An air supplying hole 12B, which is a hole having a bottom and which is continuous with the air supplying tube 12E, is formed within the air blowing nozzle 12 along the longitudinal direction of the air blowing nozzle 12. An air jetting flow path 12C is provided from the air supplying hole 12B toward the one side edge of the air blowing nozzle 12. At this side edge, the air jetting flow path 12C is connected to the air jetting opening 12A.

On the other hand, the air blowing nozzle 12 which is shown in FIGS. 3A, 3B is formed on the whole as an elongated rectangular plate shape. The dimension thereof along the direction orthogonal to the air stream jetting direction shown by the arrow in FIG. 3A is slightly greater than the width of the original lithographic printing plate web W.

The air jetting opening 12A is formed in a slit-shape in the direction orthogonal to the air stream jetting direction shown by the arrow in FIG. 3A. Wind guiding plates 12D, which are partitioning plates, are provided within the air jetting flow path 12C so as to be parallel to one another with fixed intervals therebetween along the air jetting direction, so that a uniform air stream can be jetted out from the air jetting opening 12A.

Accordingly, the air blowing nozzle 12 illustrated in FIGS. 3A, 3B can be called an air knife.

Other than these features, the air blowing nozzle 12 which is shown in FIGS. 3A, 3B has the same structure as that of the air blowing nozzle 12 illustrated in FIGS. 2A, 2B.

In a case such as when the amount of water which is applied to the original lithographic printing plate web W is too great, as will be described later, a thickly coated portion TP may be formed at a portion at which formation of a coating bead starts at the coating layer Oc, namely, a coating start portion, or in other words, the leading end portion of the coating layer Oc. When the thickly coated portion TP is formed, there are the following three cases for example: a first case in which, as shown in FIG. 4A, the thickly coated portion TP is formed in a dot shape only at the leading end portion of the coating layer Oc; a second case in which, as shown in FIG. 4B, the thickly coated portions TP are formed in dot shapes at three places, which are the leading end portion of the coating layer Oc and vicinities of the both side edge portions of the original lithographic printing plate web W; and a third case in which, as shown in FIG. 4C, the thickly coated portion TP is formed in a V-shape from the leading end portion of the coating layer Oc along both side edge portions of the original lithographic printing plate web W.

Figure 4A:
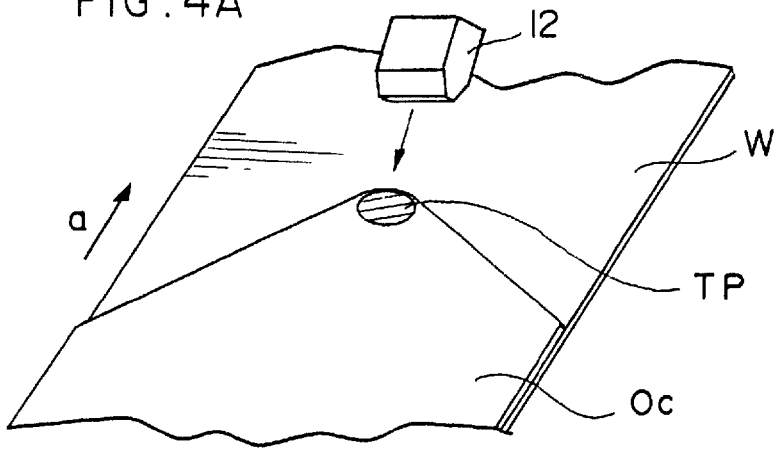
FIGS. 4A-4C are schematic views illustrating, in the slide bead type coating apparatus illustrated in FIG. 1, the relationship between the form of a thickly coated portion which is formed at a coating start portion of a coating layer of an oxidation protective layer forming liquid, and an arrangement of the air blowing nozzle(s) 12.

In the first case, as illustrated in FIG. 4A, it suffices to provide one air blowing nozzle 12, which has the form shown in FIGS. 2A, 2B, above the central portion of the original lithographic printing plate web W.

Figure 4B:
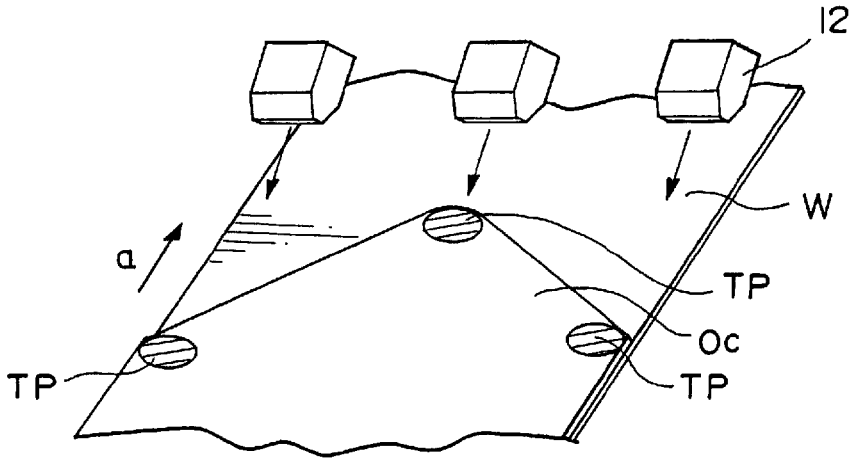

In the second case, as shown in FIG. 4B, it suffices to provide the air blowing nozzles 12, which have the form shown in FIGS. 2A, 2B, at a total of three places which are above the central portion of the original lithographic printing plate web W and above the both side edge portions.

Figure 4C:
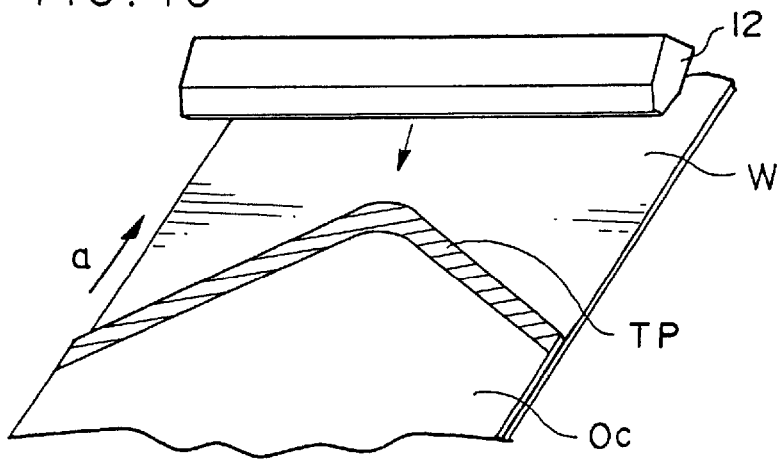

Moreover, in the third case, as shown in FIG. 4C, the air blowing nozzle 12 which has the air knife shaped form shown in FIGS. 3A, 3B can be used.

In all of the first through third cases, the air blowing nozzle 12 is disposed such that the air stream is jetted out at an angle of 0 to 90° from the air jetting opening 12A of the air blowing nozzle 12 toward the surface of the original lithographic printing plate web W which is being conveyed by the back-up roller 2. However, from the standpoints of the effect of leveling the thickly coated portion TP at the coating layer Oc and preventing spattering of the liquid at the coating layer Oc, a range of 5to 30° in particular is preferable.

When air is supplied to the interior of the air blowing nozzle 12 from the air supplying tube 12E, the air passes through the air supplying hole 12B and the air jetting flow path 12C, and a curtain-shaped stream of air is jetted out from the air jetting opening 12A. When the original lithographic printing plate web W is conveyed in this state, the curtain-shaped air stream jetted out from the air jetting opening 12A is blown onto the original lithographic printing plate web W from the downstream side in the conveying direction a.

The flow rate P of the air which is blown onto the original lithographic printing plate web W from the air jetting opening 12A of the air blowing nozzle 12 is expressed by the following relational expression:

$$1.03t-1.7 \leqq P \leqq 1.04t+1.55$$

wherein P ($m^3$/hr) is the flow rate of the air blown onto the coating liquid, and t (mm) is the distance from the object to be coated to the air jetting opening 12A.

If the flow rate of the air is within the aforementioned range, the effect of leveling the thickly coated portion TP can be sufficiently obtained. Further, the oxidation protective layer forming liquid coated on the surface of the original lithographic printing plate web W does not spatter, and foam is not generated in the oxidation protective layer forming liquid.

The operation of the slide bead type coating apparatus 100 is described hereinafter.

In the slide bead type coating apparatus 100, coating of the oxidation protective layer forming liquid onto the original lithographic printing plate web W can be started in accordance with the following procedures.

The original lithographic printing plate web W is trained around the back-up roller 2 such that the photosensitive layer of the original lithographic printing plate web W faces outwardly. The back-up roller 2 is rotated clockwise in FIG. 1 such that conveying of the original lithographic printing plate web W is started.

Then, while the oxidation protective layer forming liquid is discharged from the discharge slit 4A of the slide bead coater 4 and flows down the slide surface 4B, water is jetted out from the injector 8 through the injection needle 8A and adheres to the original lithographic printing plate web W, and a coating bead is formed between the original lithographic printing plate web W and the distal end portion 4D of the slide bead coater 4. The amount of water which is adhered to the original lithographic printing plate web W is greater than 0.05 cc, and is preferably greater than 0.05 cc and no more than 0.15 cc. Note that, in place of water, the oxidation protective layer forming liquid itself, or a diluent formed by diluting the oxidation protective layer forming liquid with water, may be adhered. In a case in which a surfactant is compounded with the oxidation protective layer forming liquid, an aqueous solution of the surfactant can be used in addition to the aforementioned water, oxidation protective layer forming liquid itself, and liquid diluent.

The way in which the coating bead spreads and changes in the planar configuration thereof on the original lithographic printing plate web W, after water supplied from the injector 8 is adhered on the original lithographic printing plate web W, are shown in FIGS. 5A through 5D. In these figures, the two-dot chain line shows the position at which the coating bead is formed on the original lithographic printing plate web W.

As is shown in FIG. 1, the water jetted out from the injection needle 8A is adhered in a dot form beneath a position, on the original lithographic printing plate web W, facing the distal end portion 4D of the slide bead coater 4, i.e., beneath a position at which the oxidation protective layer forming liquid is adhered and the coating bead is formed. Here, because the original lithographic printing plate web W is being conveyed upwardly in a vicinity of the distal end portion 4D of the slide bead coater 4, the position at which the water adheres on the original lithographic printing plate web W is at the conveying direction a upstream side of the position at which the coating bead is formed, as is shown by point Wt in FIG. 5A.

Figure 5A:
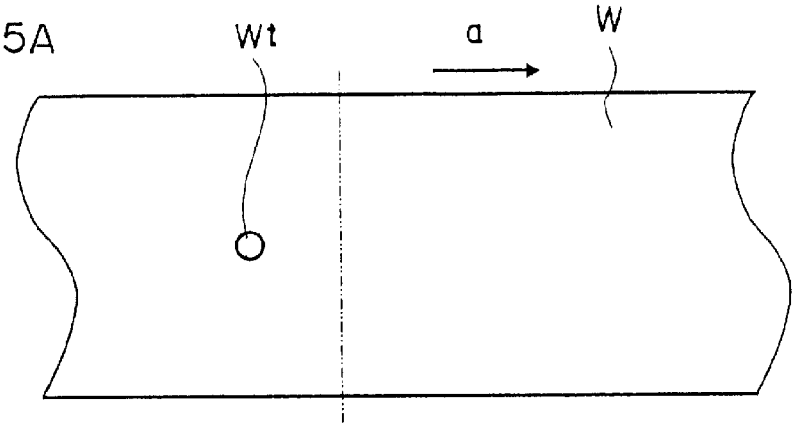
FIGS. 5A through 5D are schematic views illustrating, in the slide bead type coating apparatus illustrated in FIG. 1, changes in a planar configuration and a way of spreading of a coating bead at an original lithographic printing plate web W after water supplied from an injector has been applied to the original lithographic printing plate web.
Figure 5B:
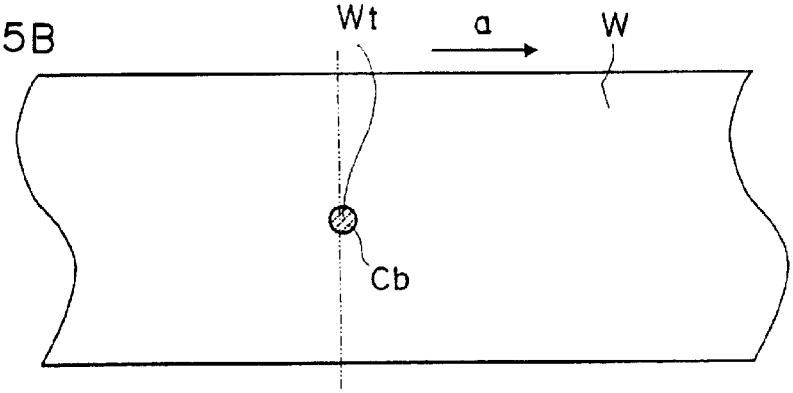
Figure 5C:
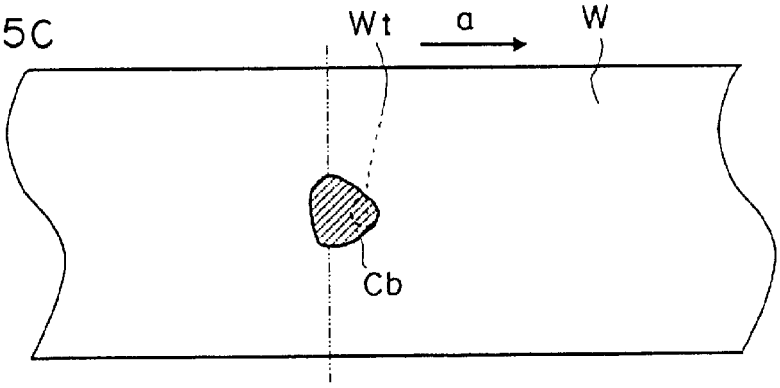
Figure 5D:
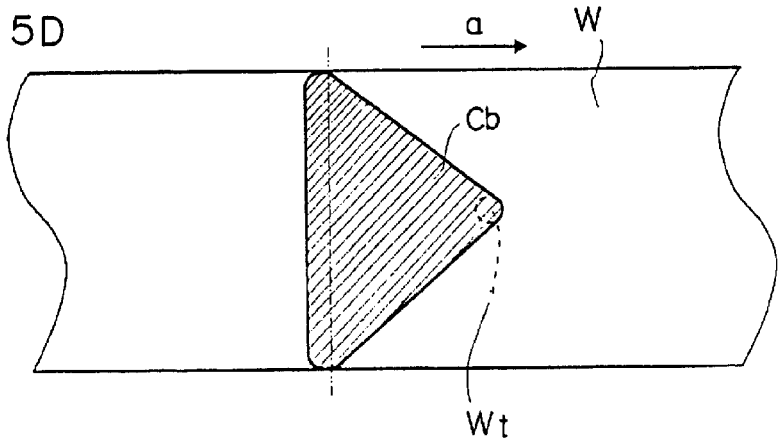

When the original lithographic printing plate web W is conveyed along the conveying direction a and the point Wt reaches a vicinity of the distal end portion 4D of the slide bead coater 4, as shown in FIG. 5B, the oxidation protective layer forming liquid which flows down the slide surface 4B adheres to the point Wt, and a coating bead Cb is formed in a dot form. Then, when the point Wt moves to the downstream side in the conveying direction a, as shown in FIG. 5C, the coating bead Cb spreads in the transverse direction of the original lithographic printing plate web W toward the direction opposite to the conveying direction a. When the point Wt moves further downstream in the conveying direction a, as shown in FIG. 5D, the coating bead Cb spreads over the entire width of the original lithographic printing plate web W.

Figure 6A:
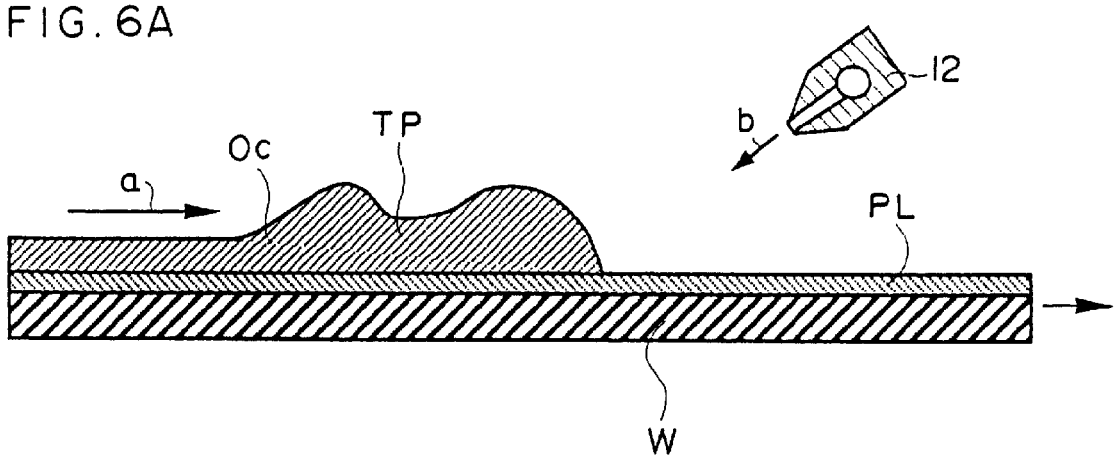
FIGS. 6A through 6C are schematic views illustrating states, in the slide bead type coating apparatus illustrated in FIG. 1, in which air is blown from an air knife onto a thickly coated portion, which is formed by the oxidation protective layer forming liquid excessively adhering to the original lithographic printing plate web W, and the thickly coated portion is leveled.
Figure 6B:
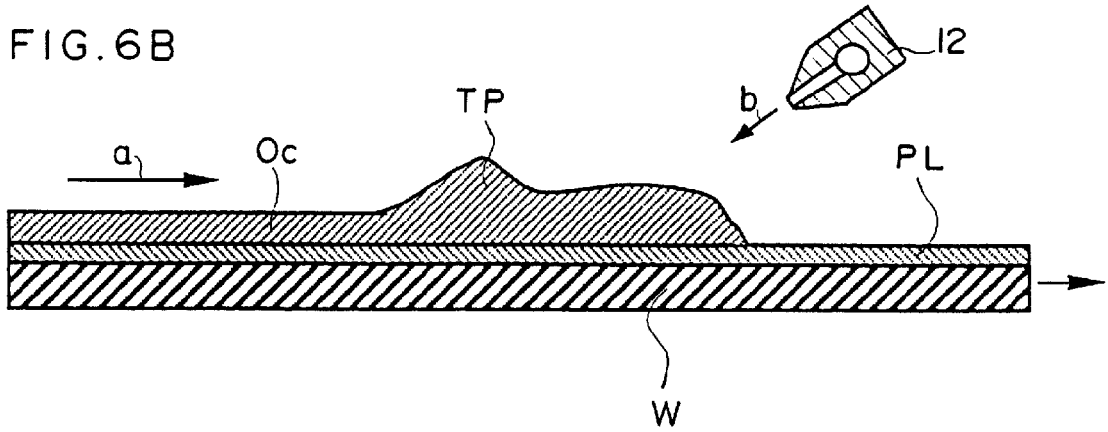
Figure 6C:
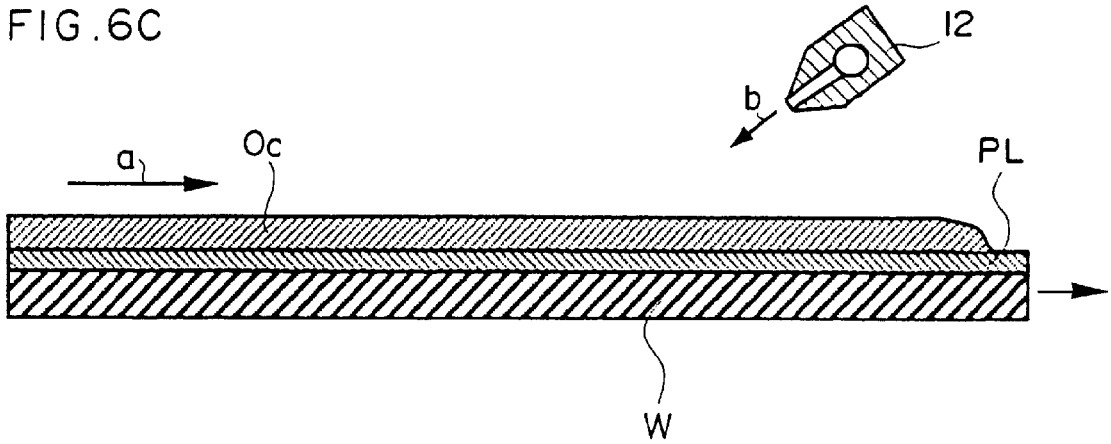

The place at which the thickly coated portion TP is leveled by the stream of air from the air blowing nozzle 12 when the thickly coated portion TP is formed at the leading end portion of the coating layer Oc, is shown in FIGS. 6A, 6B, 6C.

FIG. 6A shows a state in which the leading end portion of the coating layer Oc, which is adhered on the photosensitive layer PL of the original lithographic printing plate web W, is approaching the region at which the air stream jetted from the air blowing nozzle 12 is blown. FIG. 6B illustrates a state in which the leading end portion of the coating layer Oc is passing through the aforementioned region. FIG. 6C shows a state in which the leading end portion of the coating layer Oc has finished passing through the aforementioned region. In FIGS. 6A through 6C, the arrow b indicates the stream of air from the air blowing nozzle 12.

When, as shown in FIG. 6A, the original lithographic printing plate web W, at which the thickly coated portion is formed at the leading end of the coated layer Oc, approaches the region at which the air stream from the air blowing nozzle 12 is blown and proceeds further along the conveying direction a, as shown in FIG. 6B, the air stream from the air blowing nozzle 12 hits the leading end of the thickly coated portion TP of the coating layer Oc, and the thickly coated portion TP begins to be leveled from the leading end thereof. In the state in which the leading end portion of the coating layer Oc has finished passing through the aforementioned region, as shown in FIG. 6C, the leading end portion is leveled to a uniform thickness, and the thickly coated portion is eliminated.

Even at the start of coating, the slide bead type coating apparatus relating to the first embodiment does not move the slide bead coater 4 to make the slide bead coater 4 approach the original lithographic printing plate web W. Thus, even if the width of the slide bead coater 4 is wider than the width of the original lithographic printing plate web W, the oxidation protective layer forming liquid which is discharged from the slide bead coater 4 is not transferred onto the back-up roller 2 and does not flow around to the reverse side of the original lithographic printing plate web W.

Further, even when the thickly coated portion is formed at the leading end of the coating layer Oc of the original lithographic printing plate web W. the thickly coated portion can be leveled by blowing a stream of air from the air blowing nozzle 12. Thus, no undried portions caused by the thickly coated portion arise.

At the slide bead type coating apparatus 100, by using the slide bead coater 4 which has a plurality of discharge slits 4A, a plurality of coating layers can be simultaneously formed. Accordingly, for example, the slide bead type coating apparatus 100 equipped with the slide bead coater 4 having two discharge slits 4A which are the discharge slit 4A, which discharges a photosensitive layer forming solution which forms a photosensitive layer, and the discharge slit 4A, which discharges the oxidation protective layer forming liquid, may be used. Instead of the original lithographic printing plate web W, a support for a lithographic printing plate, in which the surface of an aluminum web has been roughened, may be conveyed, and simultaneously with the coating of the photosensitive layer forming solution, the oxidation protective layer forming liquid can be coated such that the photosensitive layer and the oxidation protective layer are formed simultaneously. In this case, instead of water, a lower alcohol such as ethyl alcohol, methyl alcohol, or the like, or a lower ketone such as acetone, methyl ethyl ketone, or the like, or a polyethylene glycol ether such as methyl cellosolve or the like, may be adhered to the support for the lithographic printing plate from the injector 8.

2. Second Embodiment

Figure 7:
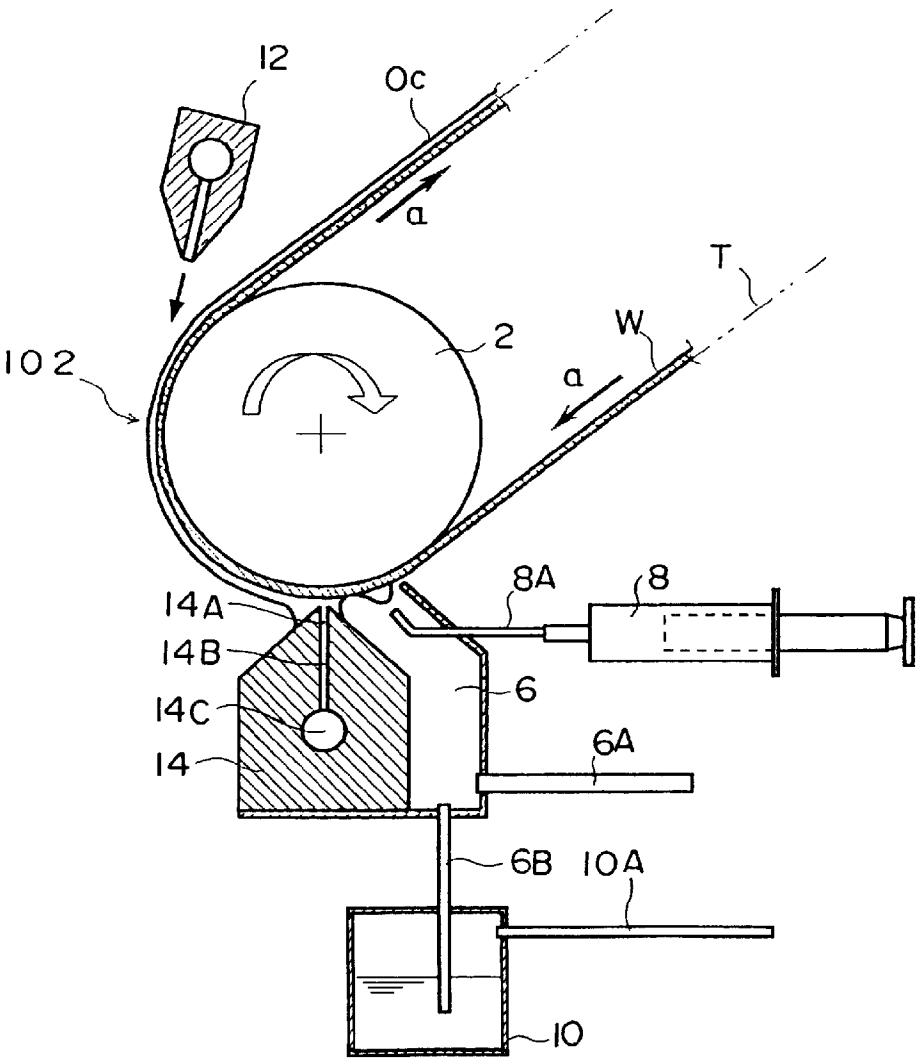
FIG. 7 is a schematic structural view illustrating a schematic structure of an example of an extrusion type coating apparatus which can be suitably used in implementing the coating method relating to the present invention.

The schematic structure of an example of an extrusion type coating apparatus, which is another example of the coating apparatus relating to the present invention, is illustrated in FIG. 7. In FIG. 7, the same reference numerals as in FIGS. 1 through 6C denote the same structural elements as in FIGS. 1 through 6C unless otherwise stated.

As shown in FIG. 7, an extrusion type coating apparatus 102 relating to the second embodiment includes the back-up roller 2, an extrusion type liquid injecting device 14, the reduced pressure chamber 6, the injector 8, and the air blowing nozzle 12. In the same way as in the slide bead type coating apparatus 100 relating to the first embodiment, the back-up roller 2 rotates clockwise in FIG. 2 and conveys the original lithographic printing plate web W. The extrusion type liquid injecting device 14 is positioned beneath the back-up roller 2, and discharges oxidation protective layer forming liquid toward the original lithographic printing plate web W which is being conveyed by the back-up roller 2. The reduced pressure chamber 6 is provided next to the extrusion type liquid injecting device 14 at the upstream side, in the conveying direction a of the original lithographic printing plate web W, of the extrusion type liquid injecting device 14. The injector 8 has the injection needle 8A which penetrates into the reduced pressure chamber 6, and functions to apply water drops to the original lithographic printing plate web W. The air blowing nozzle 12 is positioned above the back-up roller 2, and blows a stream of air obliquely, from a conveying direction a downstream side, toward the original lithographic printing plate web W on which the oxidation protective layer forming liquid has been coated.

The extrusion type liquid injecting device 14 has a substantially wedge-shaped configuration whose thickness along the conveying direction a becomes smaller along an upward direction. At the peak portion thereof, a discharge slit 14A, which is formed parallel to the axis of rotation of the back-up roller 12 and which discharges the oxidation protective layer forming liquid, opens toward the region thereabove, i.e., toward the side surface of the back-up roller 2. A coating liquid supplying hole 14C, which is a hole having a bottom and which supplies the oxidation protective layer forming liquid which is discharged from the discharge slit 14A, and a coating liquid flow path 14B, which is slit-shaped and extends upwardly from the coating liquid supplying hole 14C, are provided within the extrusion type liquid injecting device 14. The slit 14A is open at the upper end portion of the coating liquid flow path 14B.

The extrusion type liquid injecting device 14 is disposed such that a gap of about 0.1 to 1 mm is formed between the peak portion thereof and a conveying surface T of the original lithographic printing plate web W. This gap can be set in accordance with the thickness of the coating layer Oc of the oxidation protective layer forming liquid coated on the original lithographic printing plate web W.

In the same way as the reduced pressure chamber 6 and the air blowing nozzle 12 of the slide bead type coating apparatus 100 relating to the first embodiment, the reduced pressure chamber 6 and the air blowing nozzle 12 have the structures shown in FIGS. 2A, 2B and in FIGS. 3A, 3B. Further, the angle at which the stream of air is blown out from the air blowing nozzle 12 onto the original lithographic printing plate web W is the same as in the slide bead type coating apparatus 100.

In the extrusion type coating apparatus 102, coating of the oxidation protective layer forming liquid onto the original lithographic printing plate web W can begin in accordance with the following procedures.

First, in the same way as in the slide bead type coating apparatus 100 relating to the first embodiment, the original lithographic printing plate web W is trained around the back-up roller 2, and the back-up roller 2 is rotated clockwise in FIG. 7 such that conveying of the original lithographic printing plate web W is started.

Then, while the oxidation protective layer forming liquid is discharged from the discharge slit 14A of the extrusion type liquid injecting device 14, water is jetted out from the injector 8 and is adhered to the original lithographic printing plate web W. The amount of water which is adhered to the original lithographic printing plate web W is the same as in the slide bead type coating apparatus 100 relating to the first embodiment. Further, in place of water, the oxidation protective layer forming liquid itself, or a diluent formed by diluting the oxidation protective layer forming liquid with water, may be used. The present embodiment is also similar to the slide bead type coating apparatus 100 relating to the first embodiment in that, in a case in which a surfactant is compounded with the oxidation protective layer forming liquid, an aqueous solution of the surfactant can be used.

The way in which the coating bead spreads and changes in the planar configuration thereof on the original lithographic printing plate web W, after the water supplied from the injector 8 is adhered on the original lithographic printing plate web W, are the same as in the slide bead type coating apparatus 100 relating to the first embodiment, and specifically, areas shown in FIGS. 5A through 5D.

Note that, when the thickly coated portion is formed at the leading end portion of the coating layer Oc, in the same way as in the slide bead type coating apparatus 100, the thickly coated portion is leveled and eliminated as shown in FIGS. 6A through 6C by air being blown onto the thickly coated portion from the air blowing nozzle 12. Thus, undried portions caused by a thickly coated portion do not arise.

In the extrusion type coating apparatus 102 as well, in the same way as in the slide bead type coating apparatus 100, at the start of coating, there is no need to make the slide bead coater 4 approach the original lithographic printing plate web W. Thus, the oxidation protective layer forming liquid which is discharged from the extrusion type liquid injecting device is not transferred onto the back-up roller 2 and does not flow around to the reverse side of the original lithographic printing plate web W.

Further, even when the thickly coated portion is formed at the leading end of the coating layer Oc of the original lithographic printing plate web W, as described above, the thickly coated portion can be leveled by blowing a stream of air from the air blowing nozzle 12. Thus, no undried portions caused by the thickly coated portion arise.

3. Third Embodiment

Figure 8:
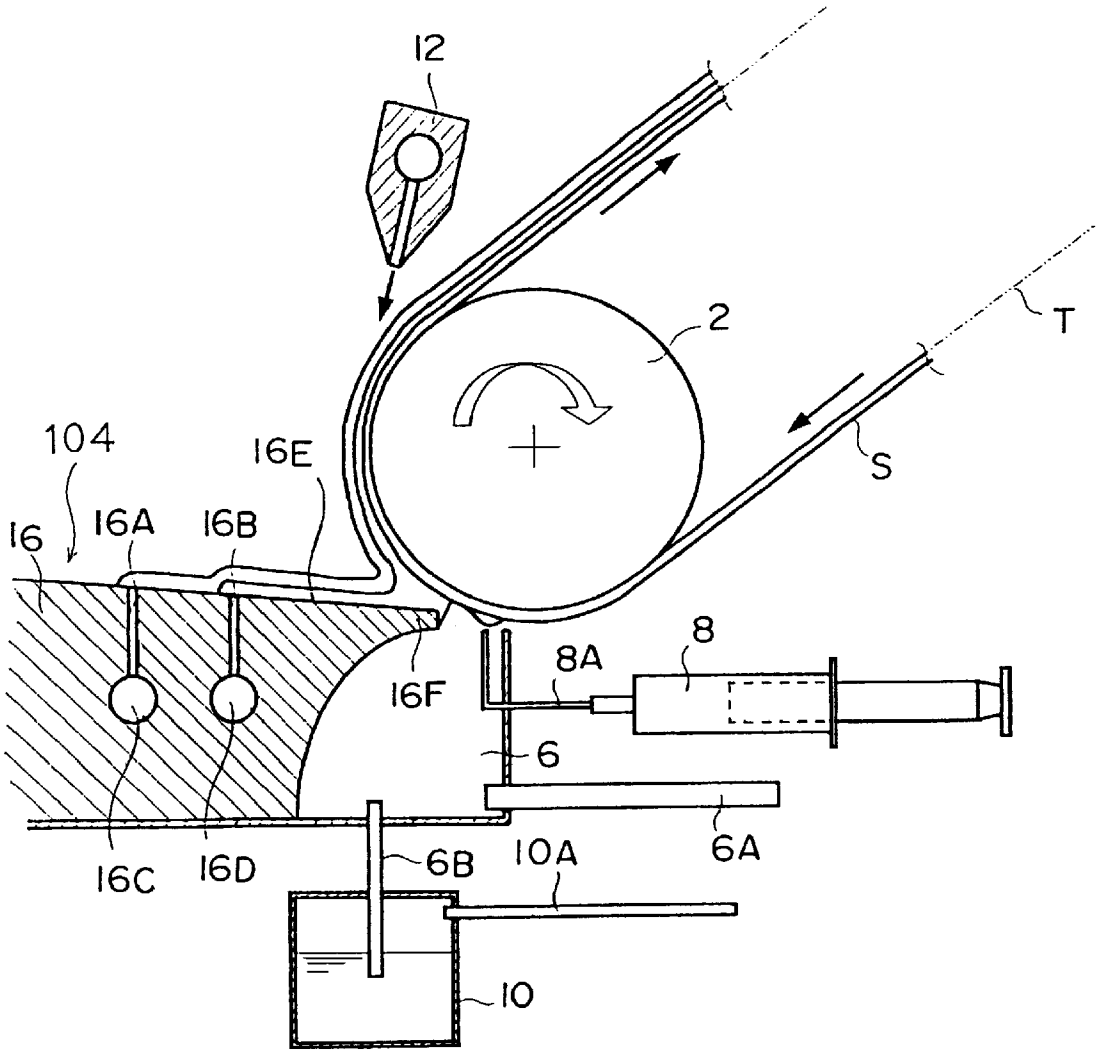
FIG. 8 is a schematic structural view illustrating a schematic structure of an example of a slide bead type coating apparatus which can be suitably used in implementing the coating method relating to the present invention, in a case in which a plurality of coating layers are formed on an object to be coated.

The schematic structure of another example of a slide bead type coating apparatus, which is included among the coating apparatuses relating to the present invention, is shown in FIG. 8. In FIG. 8, the same reference numerals as in FIGS. 1 through 6C denote the same elements.

In the example illustrated in FIG. 8, the object to be coated is a support for a lithographic printing plate which is formed by roughening one surface of an aluminum web and forming an anodized film on the roughened surface. The coating liquids are a photosensitive layer forming liquid, whose main component is an organic solvent solution of a negative type or positive type photosensitive resin, and an oxidation protective layer forming liquid which is coated on the photosensitive layer.

A slide bead type coating apparatus 104 relating to the third embodiment is equipped with the back-up roller 2, a slide bead coater 16, the reduced pressure chamber 6, and the injector 8. A support S for a lithographic printing plate is trained on a side surface of the back-up roller 2 such that the surface at the side at which the anodized film is formed faces outward. The back-up roller 2 rotates clockwise in FIG. 8 and conveys the support S for a lithographic printing plate. The slide bead coater 16 coats the photosensitive layer forming liquid on the support S for a lithographic printing plate which is trained around and conveyed by the back-up roller 2, and then coats the oxidation protective layer forming liquid. The reduced pressure chamber 6 is disposed adjacent to the slide bead coater 16 beneath the slide bead coater 16. The injector 8 applies water drops to the original lithographic printing plate web W at the interior of the reduced pressure chamber 6.

As shown in FIG. 8, in the same way as the slide bead coater 4 provided at the slide bead coating apparatus relating to the first embodiment, the slide bead coater 16 is a substantially rectangular parallel epiped block form, and has a distal end portion 16F which projects toward the back-up roller 2 and whose end edge is parallel to the side surface of the back-up roller 2. The slide bead coater 16 is disposed such that, when the support S for a lithographic printing plate is trained around the back-up roller 2 and conveyed, a gap of about 0.1 to 1 mm is formed between the support S for a lithographic printing plate and the end edge of the distal end portion 16F. The size of this gap can be determined in accordance with the thickness of the layer of the photosensitive layer forming liquid coated on the surface of the support S for a lithographic printing plate.

The slide bead coater 16 is provided with a first discharge slit 16A which discharges the oxidation protective layer forming liquid upwardly, and a second discharge slit 16B which is positioned further toward the distal end portion 16F than the first discharge slit 16A and which discharges the photosensitive layer forming liquid upwardly. The first discharge slit 16A and the second discharge slit 16B both have the same form as the discharge slit 4A provided at the slide bead coater 4 of the slide bead coating apparatus relating to the first embodiment.

The slide bead coater 16 has an oxidation protective layer forming liquid supplying hole 16C and a photosensitive layer forming liquid supplying hole 16D. The oxidation protective layer forming liquid supplying hole 16C is formed in the interior beneath the first discharge slit 16A, and supplies the oxidation protective layer forming liquid to the first discharge slit 16A. The photosensitive layer forming liquid supplying hole 16D is formed in the interior beneath the second discharge slit 16B, and supplies the photosensitive layer forming liquid to the second discharge slit 16B.

A slide surface 16E, which is a slanted surface which inclines downwardly, extends from the first discharge slit 16A toward the distal end portion 16F. Midway along the slide surface 16E, the second discharge slit 16B is formed parallel to the first discharge slit 16A.

The reduced pressure chamber 6 and the injector 8 are the same as in the slide bead coating apparatus relating to the first embodiment. However, examples of the liquid which can be adhered by the injector 8 include, in addition to water, lower alcohols such as ethyl alcohol, methyl alcohol, or the like, lower ketones such as acetone, methyl ethyl ketone, or the like, polyethylene glycol ethers such as methyl cellosolve or the like, organic solvents which are used as solvents of the photosensitive layer forming liquid, the photosensitive layer forming liquid itself, and diluents formed by diluting the photosensitive layer forming liquid by the aforementioned organic solvents.

When the oxidation protective layer forming liquid is discharged from the first discharge slit 16A and the photosensitive layer forming liquid is discharged from the second discharge slit 16B, as shown in FIG. 8, the oxidation protective layer forming liquid first flows down the slide surface 16E. When the oxidation protective layer forming liquid passes by the second discharge slit 16B, the oxidation protective layer forming liquid is pushed up by the photosensitive layer forming liquid which is discharged from the second discharge slit 16B. In a state in which a layer of the oxidation protective layer forming liquid is formed on a layer of the photosensitive layer forming liquid, the layers flow down the slide surface 16E toward the distal end portion 16F.

Here, when the water or organic solvent is adhered by the injector 8 in a drop form onto the surface of the support S for a lithographic printing plate at the side at which the anodized film is formed, in the same way as in the slide bead type coating apparatus 100 relating to the first embodiment, i.e., as shown in FIGS. 5A through 5D, the photosensitive layer forming liquid is adhered to the surface of the support S for a lithographic printing plate such that a dot-shaped coating bead is formed. This dot-shaped coating bead spreads along the transverse direction of the support S for a lithographic printing plate, such that the support S for a lithographic printing plate is covered along the entire width thereof by a layer of the photosensitive layer forming liquid. This layer of the photosensitive layer forming liquid is adhered to the support S for a lithographic printing plate in a state in which a layer of the oxidation protective layer forming liquid is layered on the layer of the photosensitive layer forming liquid. Thus, the layer of the photosensitive layer forming liquid and the layer of the oxidation protective layer forming liquid are simultaneously formed on the support S for a lithographic printing plate.

In a case in which the amount of water or organic solvent adhered by the injector 8 is too large, the photosensitive layer forming liquid may adhere excessively to the support S for a lithographic printing plate, and a thickly coated portion may be formed at the leading end portion of a coating layer Ps formed by the photosensitive layer forming liquid. However, when the stream of air from the air blowing nozzle 12 hits this thickly coated portion, the thickly coated portion at the coating layer Ps is leveled and eliminated. How the thickly coated portion is leveled when the air stream from the air blowing nozzle 12 hits the thickly coated portion is shown in FIGS. 9A through 9C.

Figure 9A:
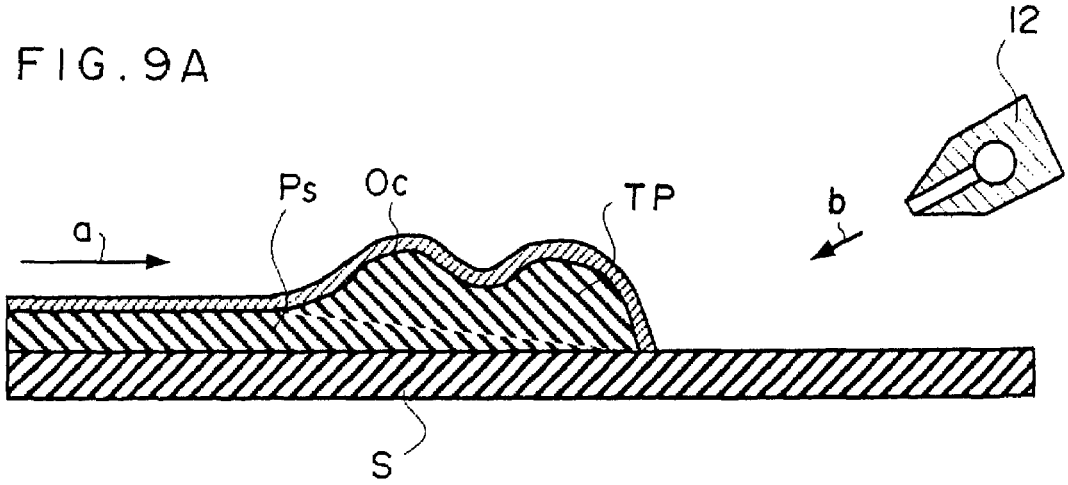
FIGS. 9A through 9C are schematic views illustrating states, in the slide bead type coating apparatus illustrated in FIG. 8, in which air is blown from the air blowing nozzle 12 onto a thickly coated portion, which is formed by a photosensitive layer forming liquid excessively adhering to the original lithographic printing plate web W, and the thickly coated portion is leveled.
Figure 9B:
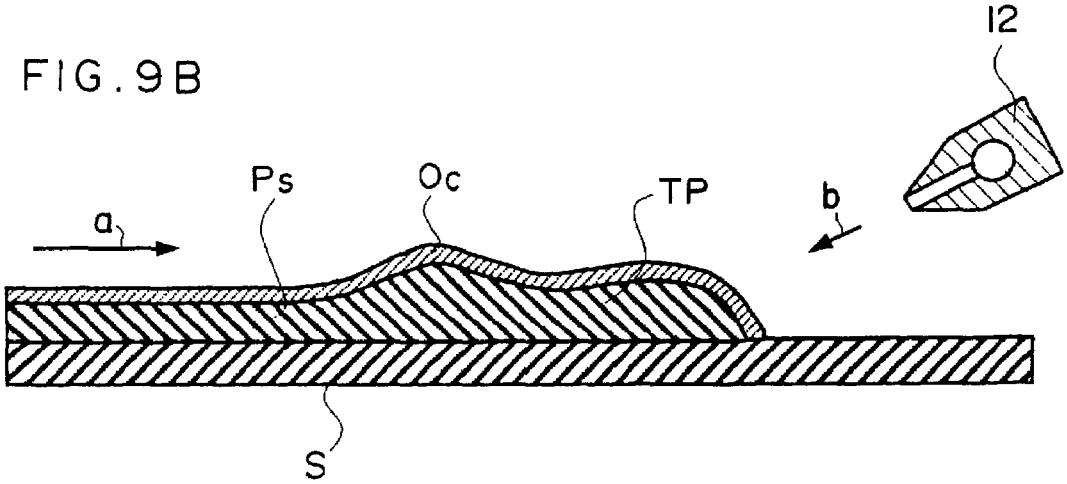
Figure 9C:
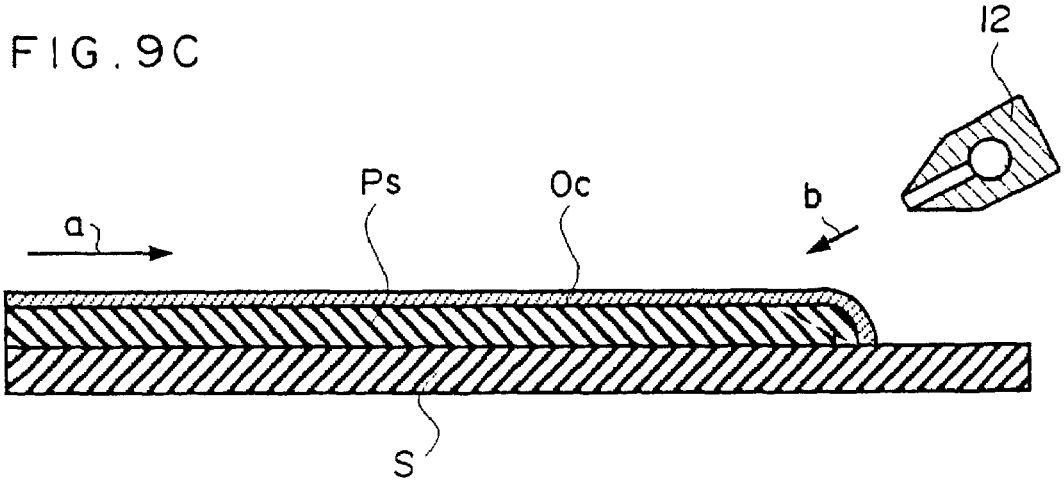

As shown in FIGS. 9A through 9C, when the air stream (shown by arrow b in FIGS. 9A through 9C) jetted out from the air blowing nozzle 12 hits the thickly coated portion TP at the coating layer Ps, the thickly coated portion TP is successively leveled from the leading end portion of the coating layer Ps. When the air stream from the air blowing nozzle 12 passes by the thickly coated portion, the thickly coated portion is eliminated.

In addition to the merits of the slide bead type coating apparatus of the first embodiment, the slide bead type coating apparatus relating to the third embodiment has the advantage that it can be preferably used to simultaneously form two or more coating layers on an object to be coated such as the support S for a lithographic printing plate. Note that the coating liquids which are used in the slide bead coating apparatus are not limited to the above-described photosensitive layer forming liquid and oxidation protective layer forming liquid.

Hereinafter, the present invention will be described in further detail by using Experimental Examples. However, the present invention is not limited to the following Experimental Examples.

EXPERIMENTAL EXAMPLE 1

By using the slide bead coating apparatus shown in FIG. 1, while an original lithographic printing plate web, which was the same as that described in the first embodiment, was conveyed at a speed of 60 m/min, a liquid coating composition, which was water based and whose main component was a polyvinyl alcohol aqueous solution and whose viscosity was 10 cP, was coated on the surface of the photosensitive layer of the original lithographic printing plate web as an oxidation protective layer forming liquid in a coating amount of 40 cc/m$^2$. At the start of coating, when 0.10 cc of water was adhered in drop form to the surface of the photosensitive layer of the original lithographic printing plate web by using the injector 8, the liquid coating composition could be reliably applied, and coating could be reliably started.

EXPERIMENTAL EXAMPLE 2

Coating of a liquid coating composition was carried out in the same way as in Experimental Example 1, except that the amount of water which was adhered to the original lithographic printing plate web at the start of coating was 0.05 cc.

However, at the start of coating, the liquid coating composition could only be applied on the original lithographic printing plate web at a probability of 50%, and coating could not be reliably started.

EXPERIMENTAL EXAMPLE 3

Coating of a liquid coating composition was carried out in the same way as in Experimental Example 1, except that the amount of water which was adhered to the original lithographic printing plate web at the start of coating was 0.15 cc. Although coating could be reliably started, the liquid coating composition was excessively applied on the original lithographic printing plate web, and thickly coated portions were formed as far as 30 to 50 mm downstream, along the conveying direction a, from the portion where formation of the coating bead started at the coating layer of the liquid coating composition. Here, when a curtain-shaped stream of air was blown out along the entire width of the original lithographic printing plate web at an angle of 30° with respect to the original lithographic printing plate web onto the thickly coated portions from the air blowing nozzle 12, the thickly coated portions were eliminated while the original lithographic printing plate web was conveyed 300 to 500 mm, and the generation of undried portions was not observed.

From Experimental Examples 1 through 3, it can be understood that if the conveying speed of the original lithographic printing plate web, the composition, viscosity, and coating amount of the liquid coating composition, the distance between the slide bead coater and the original lithographic printing plate web, and the like satisfy the above-described conditions, it is preferable that the amount of water which is adhered onto the original lithographic printing plate web be greater than 0.05 cc. However, if the conveying speed of the original lithographic printing plate web and the like are different from the above-described conditions, it can be thought that the preferable range of the amount of water to be adhered onto the original lithographic printing plate web is different than the aforementioned range.

EXPERIMENTAL EXAMPLE 4

Figure 10:
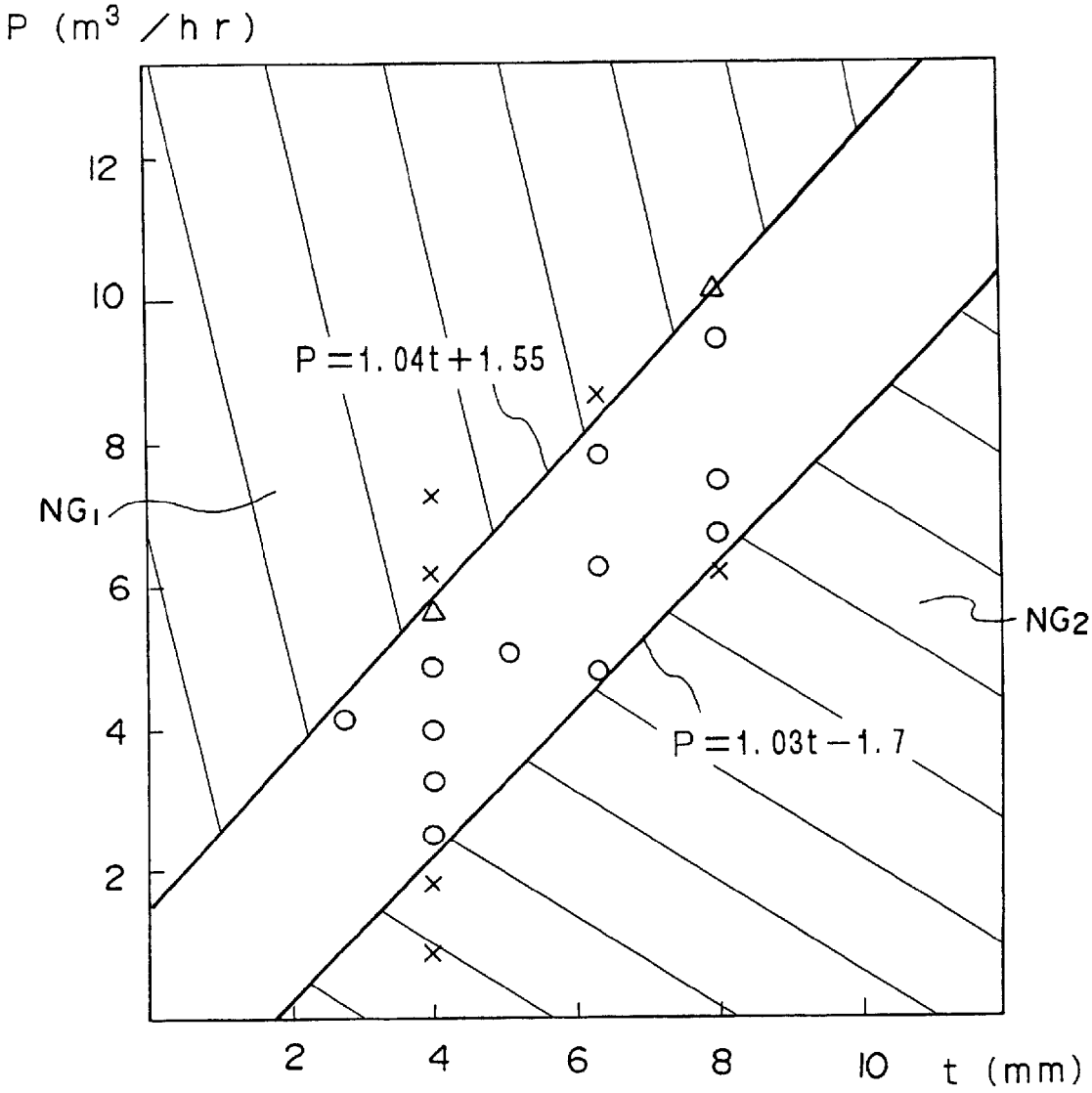
FIG. 10 is a graph showing the relationship between the effect of leveling a thickly coated portion and the presence/absence of liquid spattering and generation of foam, and P and t, at a time when P and t are changed in various ways and coating of a liquid coating composition onto an original lithographic printing plate web is carried out by using the slide bead type coating apparatus illustrated in FIG. 1, wherein t is a clearance (mm) from a distal end of an air knife to the original lithographic printing plate web, and P ($m^3$/hr) is the flow rate of air jetted out from the air knife.

As shown in FIG. 10, coating of a liquid coating composition was carried out in the same way as in Experimental Example 3, except that the clearance t (mm) from the distal end of the air blowing nozzle 12 to the original lithographic printing plate web, and the flow rate P (m$^3$/hr) of air jetted out from the air blowing nozzle 12, were changed in various ways. As shown in FIG. 10, the results thereof are that when P and t fell in a region sandwiched between the straight line P=1.03t−1.7 and the straight line P=1.04t+1.55, the effect of leveling the thickly coated portion was sufficiently obtained, and liquid spattering and foaming did not occur. Note that, in FIG. 10, "○" means that the effect of leveling the thickly coated portion was sufficiently obtained and that liquid spattering and foaming did not occur, "X" means that the effect of leveling the thickly coated portion was not sufficiently obtained or that liquids pattering or foaming occurred at a level which was not acceptable, and "Δ" means that the effect of leveling the thickly coated portion and prevention of liquid spattering and foaming both were in permissible ranges. Also in FIG. 10, $NG_1$ denotes a region in which liquid spattering and generation of foaming occurred, and $NG_2$ denotes a region in which there was no leveling effect.

Note that if the conditions for coating the original lithographic printing plate web are different than in Experimental Example 3, it can be thought that the suitable range of the flow rate P of the air jetted out from the air blowing nozzle 12 also is different than the range shown in FIG. 10.

As described above, the present invention provides a coating method and a coating apparatus in which, at the start of coating, there is no need to apply solution by manual work, and in which coating can be started reliably, and by which thickly coated portions do not arise.

What is claimed is:

1. A coating apparatus for coating a coating liquid onto a web which is traveling, the coating apparatus comprising:

a slide bead coater which includes at least one discharge slit which discharges the coating liquid, and a slide surface along which the coating liquid from the discharge slit flows down, the slide bead coater forming a bridge of the coating liquid in a gap between a distal end portion of the slide surface and the web;

a liquid drop injector having an injection needle which injects a liquid drop of a predetermined liquid at a web traveling direction upstream side of a position at which the bridge of the coating liquid is formed, and starts formation of the bridge of the coating liquid; and means for leveling off the coating of coating liquid on the web without removing the coating of coating liquid from the web, the means for leveling off including an air blowing nozzle, wherein the liquid drop of the predetermined liquid comprises a surface tension which is greater than or equal to a surface tension of the coating liquid, wherein said air blowing nozzle is disposed above a back-up roller and the web, wherein said back-up roller is positioned to support the web where said bridge of coating liquid is formed between the distal end portion of the slide surface of said slide bead coater and the web, wherein said air blowing nozzle is disposed above a portion of the web supported on the back-up roller so as to blow air at said portion of the web from a position above said portion of the web.

2. The coating apparatus according to claim 1, wherein the web comprises an original lithographic printing plate web, and the coating liquid comprises an oxidation protective layer forming liquid.

3. The coating apparatus according to claim 1, wherein the web comprises a support for a lithographic printing plate, and the coating liquid comprises a photosensitive layer forming liquid and an oxidation protective layer forming liquid.

4. The coating apparatus according to claim 1, wherein the predetermined liquid is soluble with respect to the coating liquid.

5. The coating apparatus according to claim 1, wherein the predetermined liquid comprises the coating liquid.

6. The coating apparatus according to claim 1, wherein an applied amount of the liquid drop is greater than 0.05 cc.

7. The coating apparatus according to claim 1, wherein the discharge slit discharges the coating liquid in a strip form.

8. The coating apparatus according to claim 1, wherein the liquid drop injector applies the liquid drop before a start of coating.

9. The coating apparatus according to claim 1, wherein the air blowing nozzle blows a curtain-shaped gas stream one of parallel to and obliquely to a traveling path of the web.

10. The coating apparatus of claim 9, wherein said air nozzle is disposed above said portion of the web so that air is blown obliquely at an angle of 5 to 30° from an opening of said air nozzle with respect to said portion of the web.

11. The coating apparatus of claim 1, wherein said coating apparatus further comprises a reduced pressure chamber on the upstream side of said slide bead coater in which said injection needle is disposed.

12. A coating apparatus for coating a coating liquid onto a web which is traveling, the coating apparatus comprising:

a slide bead coater for forming a bridge of the coating liquid between the web and a distal end portion of a slide surface of the slide bead coater;

a conveying device for making the web travel, wherein said conveying device includes a back-up roller positioned to support the web where a bridge of coating liquid is formed between the distal end portion of the slide surface of the slide bead coater and the web; and a blowing device for blowing a gas from a direction which is substantially opposite to a traveling direction of the web, toward a portion of the web at which coating of the coating liquid starts, wherein the blowing device is positioned above said back-up roller and a portion of the web supported on said back-up roller so as to blow a above said portion of the web.

13. The coating apparatus according to claim 12, wherein the blowing device includes an air knife which blows a generally curtain-shaped gas stream one of parallel to and obliquely to a traveling path of the web.

14. The coating apparatus according to claim 12, wherein, given that a distance from the web to the blowing device is t (mm), a flow rate P (m3/hr) of the gas blown at the blowing device satisfies a following relational expression:

$$1.03t-1.7 \leqq P \leqq 1.04t+1.55.$$

15. The coating apparatus according to claim 12, further comprising a liquid drop applying device which is for applying a liquid drop of a predetermined liquid at a web traveling direction upstream side of a position at which the bridge of the coating liquid is formed, and starting formation of the bridge of the coating liquid.

16. The coating apparatus according to claim 12, wherein the slide bead coater includes a discharge slit which discharges the coating liquid in strip form, and the slide surface along which the coating liquid discharged from the discharge slit flows down.

* * * * *